US010321216B2

(12) United States Patent
Murozaki

(10) Patent No.: US 10,321,216 B2
(45) Date of Patent: Jun. 11, 2019

(54) WEARABLE DEVICE

(71) Applicant: SONY CORPORATION, Tokyo (JP)

(72) Inventor: Katsunori Murozaki, Chiba (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/557,891

(22) PCT Filed: Dec. 4, 2015

(86) PCT No.: PCT/JP2015/084123
§ 371 (c)(1),
(2) Date: Sep. 13, 2017

(87) PCT Pub. No.: WO2016/151952
PCT Pub. Date: Sep. 29, 2016

(65) Prior Publication Data

US 2018/0077480 A1 Mar. 15, 2018

(30) Foreign Application Priority Data

Mar. 23, 2015 (JP) ..... 2015-059465

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 25/658; H04R 25/652; H04R 2225/023; H04R 25/656; H04R 25/602;
(Continued)

(56) References Cited

U.S. PATENT DOCUMENTS 6,738,487 B1 * 5/2004 Nageno ..... H04R 1/1016 381/322
2005/0123163 A1 6/2005 Oliveira et al.
(Continued)

FOREIGN PATENT DOCUMENTS

CN 101207935 A 6/2008
CN 101374364 A 2/2009
(Continued)

OTHER PUBLICATIONS

International Search Report and Written Opinion of PCT Application No. PCT/JP2015/084123, dated Feb. 16, 2016, 09 pages of ISRWO.

*Primary Examiner* — Curtis A Kuntz
*Assistant Examiner* — Julie X Dang
(74) *Attorney, Agent, or Firm* — Chip Law Group

(57) ABSTRACT

To provide a wearable device a part of which directly comes in contact with the skin of a living body includes silicone foam and which is excellent in durability and comfortability. An earpiece 150 includes a core 152 that is attached to a sound conduit 140, and an ear canal attachment section 156 that is attached to an outer side of the core 152 and comes into contact with an ear canal inner wall of a wearer. The ear canal attachment section 156 over the entire exterior of which soft silicone foam, which is a foamed material, is disposed, can keep close contact with an ear canal and comfortable wearability, while the core 152 made from silicone rubber allows a tip portion of the sound conduit 140 to have a shape to be easily wound, which prevents a sound path from being blocked.

12 Claims, 19 Drawing Sheets

(58) Field of Classification Search
CPC .... H04R 25/65; H04R 25/654; H04R 25/604; H04R 1/1016; H04R 25/608; H04R 2460/11; H04R 2225/77; H04R 2460/17
USPC ..... 381/328, 322, 324, 380, 323, 325, 312, 381/329, 370
See application file for complete search history.

(56) References Cited

U.S. PATENT DOCUMENTS

| | | | | |
|---|---|---|---|---|
| 2005/0190938 | A1 | 9/2005 | Shennib et al. | |
| 2005/0249370 | A1 | 11/2005 | Shennib et al. | |
| 2008/0152163 | A1 | 6/2008 | Mulvey | |
| 2009/0052711 | A1* | 2/2009 | Murozaki | H04R 1/1091 381/328 |
| 2010/0246879 | A1* | 9/2010 | Siahaan | B29C 43/021 381/380 |
| 2011/0268308 | A1* | 11/2011 | Vasquez | H04R 1/1016 381/380 |
| 2013/0188819 | A1* | 7/2013 | Young-Mun | H04R 25/652 381/380 |
| 2013/0315411 | A1 | 11/2013 | Annunziato et al. | |
| 2014/0166389 | A1* | 6/2014 | Young-Mun | H04R 1/1016 181/135 |

FOREIGN PATENT DOCUMENTS

| | | | |
|---|---|---|---|
| CN | 104429097 | A | 3/2015 |
| EP | 1692916 | A2 | 8/2006 |
| EP | 1730991 | A2 | 12/2006 |
| EP | 1937031 | A1 | 6/2008 |
| EP | 2856771 | A1 | 4/2015 |
| JP | 58-076299 | U | 5/1983 |
| JP | 1983-076299 | U | 5/1983 |
| JP | 3121893 | U | 6/2006 |
| JP | 2006-246426 | A | 9/2006 |
| JP | 2007-519312 | A | 7/2007 |
| JP | 2007-523539 | A | 8/2007 |
| JP | 2008-160847 | A | 7/2008 |
| JP | 2009-027675 | A | 2/2009 |
| JP | 2009-055249 | A | 3/2009 |
| JP | 2013-168981 | A | 8/2013 |
| JP | 2014-007478 | A | 1/2014 |
| JP | 2014-087054 | A | 5/2014 |
| JP | 2015-521008 | A | 7/2015 |
| KR | 10-2007-0015503 | A | 2/2007 |
| WO | 2005/062670 | A2 | 7/2005 |
| WO | 2005/076991 | A2 | 8/2005 |
| WO | 2013/177285 | A1 | 11/2013 |

* cited by examiner

WEARABLE DEVICE

CROSS REFERENCE TO RELATED APPLICATIONS

This application is a U.S. National Phase of International Patent Application No. PCT/JP2015/084123 filed on Dec. 4, 2015, which claims priority benefit of Japanese Patent Application No. JP 2015-059465 filed in the Japan Patent Office on Mar. 23, 2015. Each of the above-referenced applications is hereby incorporated herein by reference in its entirety.

TECHNICAL FIELD

The technology disclosed herein relates to a wearable device that is used directly in contact with the skin of a living body.

BACKGROUND ART

Devices (which will also be referred to as "wearable devices") that are worn and used by human bodies or other living bodies have been gaining widespread use with smaller and lighter electronic parts. Many of the wearable devices are directly attached to living bodies or directly come into contact with the skin or body parts of the living bodies when used.

For example, headphones that have already been used widely are small audio reproduction devices that are attached to the area near the earholes of humans when used, and convert electrical signals output from reproduction devices and receivers into audio signals through speakers positioned near the ears or eardrums. Audio reproduction devices of this type each emit sounds to allow only the listener wearing the audio reproduction device to listen to the sounds, so that the audio reproduction devices are used in a variety of environments.

Many of the currently popular headphones are shaped to be plugged into the ears of listeners. For example, inner ear headphones belong to an "earplug type," and the tips of the sound conduits including earpieces (or ear tips) made from a flexible material are plugged into ear canal entrances of listeners. Earpieces including shade-shaped films made from silicone rubber are in the mainstream (see, for example, Patent Literature 1). Moreover, there appear earpieces each of which includes a foamed material in the space between the shade-shaped outer sheath and the sound wave path (see, for example, Patent Literature 2), and earpieces the whole of which is formed from a foamed material, and which uses the cushioning characteristics to close ear canals.

Urethane-based foamed materials such as polyurethane are in the mainstream at the time when the present application is filed. However, urethane-based foamed materials easily hydrolyze. Accordingly, urethane-based foamed materials are insufficient for wearable devices from the perspective of durability. For example, in a case where an earpiece the whole exterior of which is formed from polyurethane is used directly in contact with the skin (such as the inner wall of the ear canal) of a living body, the surface of the earpiece hydrolyzes and deteriorates because of sweat. The comfortability is gradually lost. Further, in a case where an earpiece the whole of which is made from polyurethane is manufactured through in-mold foaming, the outer periphery of the earpiece that directly comes into contact with an earhole (inner wall of the ear canal) becomes hard or sticky because of the coating, resulting in the decreased comfortability. Further, in a case where an earpiece the whole of which is made from polyurethane is processed through slicing or cutting, all the shapes that the earpiece can have is a simple one such as a solid of revolution, resulting in the decreased comfortability. Alternatively, processing an earpiece having a complicated shape through slicing or cutting increases the cost.

CITATION LIST

Patent Literature

Patent Literature 1: JP 2009-55249A
Patent Literature 1: JP 2014-87054A

DISCLOSURE OF INVENTION

Technical Problem

An object of the technology disclosed herein is to provide a wearable device that is used directly in contact with the skin of a living body and excellent in durability and comfortability.

Solution to Problem

The technology disclosed herein is devised in view of the above-described problem, and a first aspect thereof is a wearable device including: a contact section that has silicone foam disposed over a whole exterior thereof, and comes into contact with a skin of a living body; and a support section of the contact section.

According to a second aspect of the technology disclosed herein, the wearable device according to the first aspect is configured as an earpiece for a headphone that is plugged into an ear canal of a human or another living body. The support section is a hollow shaft that is attached to a sound conduit of the headphone, and the contact section is an ear canal attachment section that is attached to an outer side of the shaft and comes into contact with an ear canal inner wall.

According to a third aspect of the technology disclosed herein, the shaft of the wearable device according to the second aspect includes a more rigid material than a material of the ear canal attachment section.

According to a fourth aspect of the technology disclosed herein, the shaft of the wearable device according to the second aspect includes silicone rubber.

According to a fifth aspect of the technology disclosed herein, the earpiece of the wearable device according to the fourth aspect is manufactured by applying insert molding to the shaft and the ear canal attachment section.

According to a sixth aspect of the technology disclosed herein, the shaft of the wearable device according to any of the second to fifth aspects includes a deformation section that easily deforms in accordance with an external force applied via the ear canal attachment section.

According to a seventh aspect of the technology disclosed herein, the deformation section of the wearable device according to the sixth aspect is formed by making the shaft thinner toward a shaft tip.

According to an eighth aspect of the technology disclosed herein, the deformation section of the wearable device according to the sixth aspect is formed from a more elastic material than a material of another portion of the shaft.

According to a ninth aspect of the technology disclosed herein, the shaft of the wearable device according to any of the first to eighth aspects further includes a thick section that makes an opening at a tip of the shaft difficult to crush.

According to a tenth aspect of the technology disclosed herein, the thick section of the wearable device according to the ninth aspect is provided to the tip of the shaft.

According to an eleventh aspect of the technology disclosed herein, the wearable device according to any of the second to tenth aspects further includes: a shade section that includes a thin film and forms a space between the shade section and the shaft. The ear canal attachment section is attached to the shaft via the shade section.

Advantageous Effects of Invention

According to the technology disclosed herein, it is possible to provide a wearable device a part of which directly comes in contact with the skin of a living body includes silicone foam and which is excellent in durability and comfortability.

Note that the advantageous effects described in this specification are merely for the sake of example, and the advantageous effects of the present invention are not limited thereto. Furthermore, in some cases the present invention may also exhibit additional advantageous effects other than the advantageous effects given above.

Further objectives, features, and advantages of the technology disclosed in this specification will be clarified by a more detailed description based on the exemplary embodiments discussed hereinafter and the attached drawings.

MODE(S) FOR CARRYING OUT THE INVENTION

Embodiments of the present disclosure will be described below in detail with reference to the drawings.

FIGS. 1 to 6 illustrate the exterior configuration of a headphone 100 to which an earpiece 150 to which the technology disclosed herein is applied is attached. The headphone 100 according to the present embodiment, however, belongs to an "earplug type," and has the earpiece 150 attached to the tip of a sound conduit 140 and plugged into an ear canal entrance of a human (which will be referred to as "wearer"). The earpiece 150 is made from a flexible material.

Figure 1:
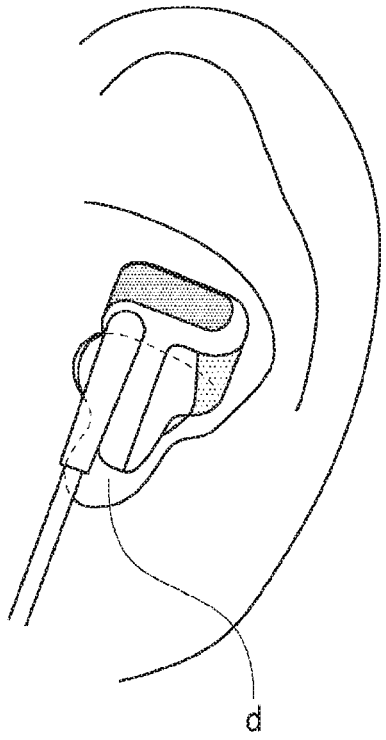
FIG. 1 is a diagram illustrating an exterior configuration of a headphone 100 to which a technology disclosed herein is applied.
Figure 2:
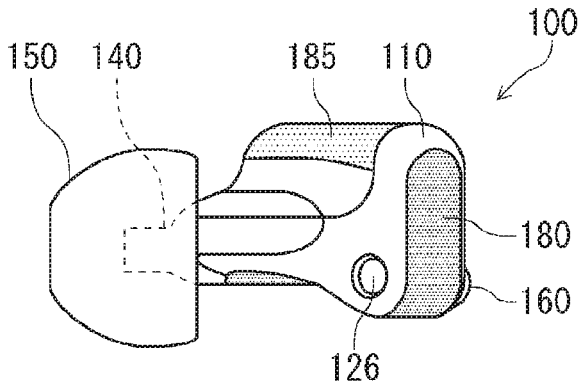
FIG. 2 is a diagram illustrating the exterior configuration of the headphone 100 to which the technology disclosed herein is applied.
Figure 3:
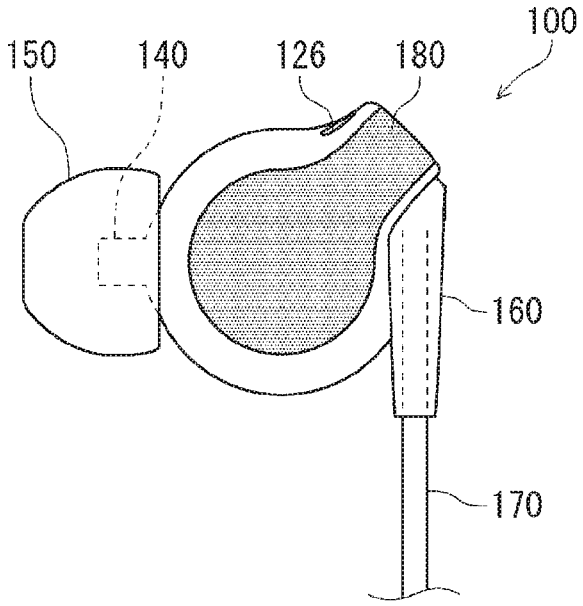
FIG. 3 is a diagram illustrating the exterior configuration of the headphone 100 to which the technology disclosed herein is applied.
Figure 4:
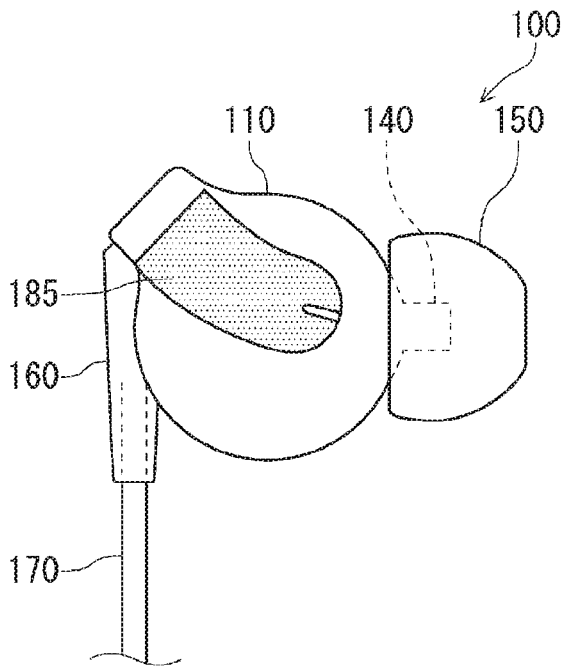
FIG. 4 is a diagram illustrating the exterior configuration of the headphone 100 to which the technology disclosed herein is applied.
Figure 5:
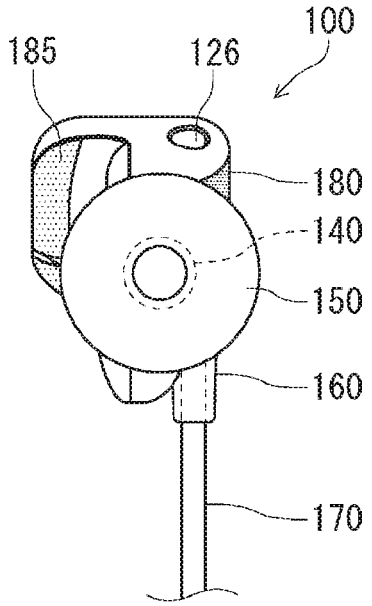
FIG. 5 is a diagram illustrating the exterior configuration of the headphone 100 to which the technology disclosed herein is applied.
Figure 6:
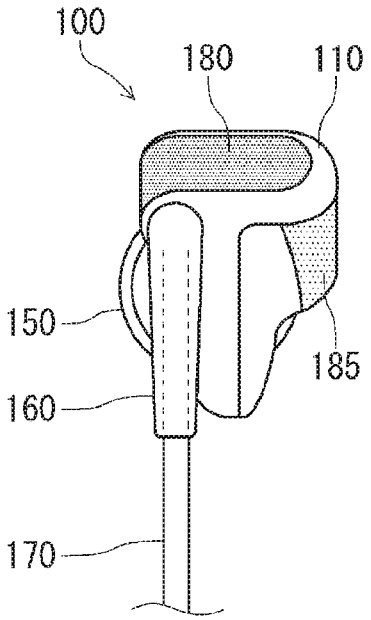
FIG. 6 is a diagram illustrating the exterior configuration of the headphone 100 to which the technology disclosed herein is applied.

FIGS. 1 to 6 illustrate the configuration of the headphone 100 worn in the left ear of a wearer. FIG. 1 illustrates the appearance of the headphone 100 worn in the left ear of a wearer. FIG. 2 is a perspective view obliquely illustrating the back of the headphone 100. FIG. 3 is a front view illustrating the headphone 100 worn in the left ear of a wearer from the frontal direction of the wearer. FIG. 4 is a back view illustrating the headphone 100 worn in the left ear of a wearer from the back direction of the wearer. FIG. 5 is a frontal view of the headphone 100. FIG. 6 is a back view of the headphone 100 (corresponding to a view illustrating a wearer wearing the headphone 100 from the side).

As illustrated in FIGS. 1 to 6, the headphone 100 includes a housing 110 that is shaped substantially like a disk, a sound conduit 140 that protrudes from the housing 110 and is shaped substantially like a cylinder, and an earpiece 150 that is attached to the tip of the sound conduit 140. Further, the headphone 100 includes a bushing 160 on the back side, and a cord 170 that is held by the bushing 160. The bushing 160 protrudes from the housing 110. The housing 110 is partially covered with a front cap 180 that is bent and shaped substantially like the letter L, and a back cap 185 that is shaped substantially like a half cylinder.

The housing 110 is formed from a light and solid material such as magnesium in order to make the case smaller and thinner. A driver unit (described below) including a diaphragm is housed in the housing 110, and a space surrounding the front of the diaphragm is formed in the housing 110. The driver unit drives the diaphragm in accordance with sound signals supplied via the cord 170, thereby generating air vibration in the front space of the diaphragm. Additionally, the top of the housing 110 has an air vent 126 that allows the front space of the diaphragm to communicate with the outside of the housing 110.

The sound conduit 140 is integrated with the housing 110 to protrude toward the frontal side of the earphone 100, and plugged into an ear canal of a human via the earpiece 150. The sound conduit 140 conducts the air vibration generated by the driver unit (described below) to the ear canal as the sound waves in the audible range corresponding to the sound signals.

The earpiece 150 deforms to follow the shape of the ear canal of the left ear of a human wearing the earpiece 150, and comes into close contact with the ear canal, thereby having the ear canal hold the housing 110. Earpieces including a shade-shaped silicone rubber film have gained widespread use. In contrast, soft silicone foam, which is a foamed material, is disposed over the whole exterior of the earpiece 150 according to the present embodiment. Further, the tip portion of the sound conduit 140 in the earpiece 150 is shaped to be easily wound without blocking the sound path, making it possible to keep the comfortable wearability while allowing the earpiece 150 to keep close contact with the ear canal. The earpiece 150 will be described below in detail.

The bushing 160 is formed from an elastic material such as elastomer. The bushing 160 fixes, to the housing 110, the position at which the cord 170 connected to the driver unit (described below) is pulled out. The bushing 160 extends from the back side of the housing 110 in consideration of the interference with the pinna. When the headphone 100 is worn in the left ear of a human, the bushing 160 faces the substantially perpendicular direction and is disposed to be easy for the human to pinch between fingertips.

The front cap 180 is formed, for example, from stainless steel or the like. Further, back cap 185 is formed, for example, from plastics or the like. The front cap 180 and the back cap 185 protect the housing 110, the cord 170, an air vent described below, and the like.

Figure 7:
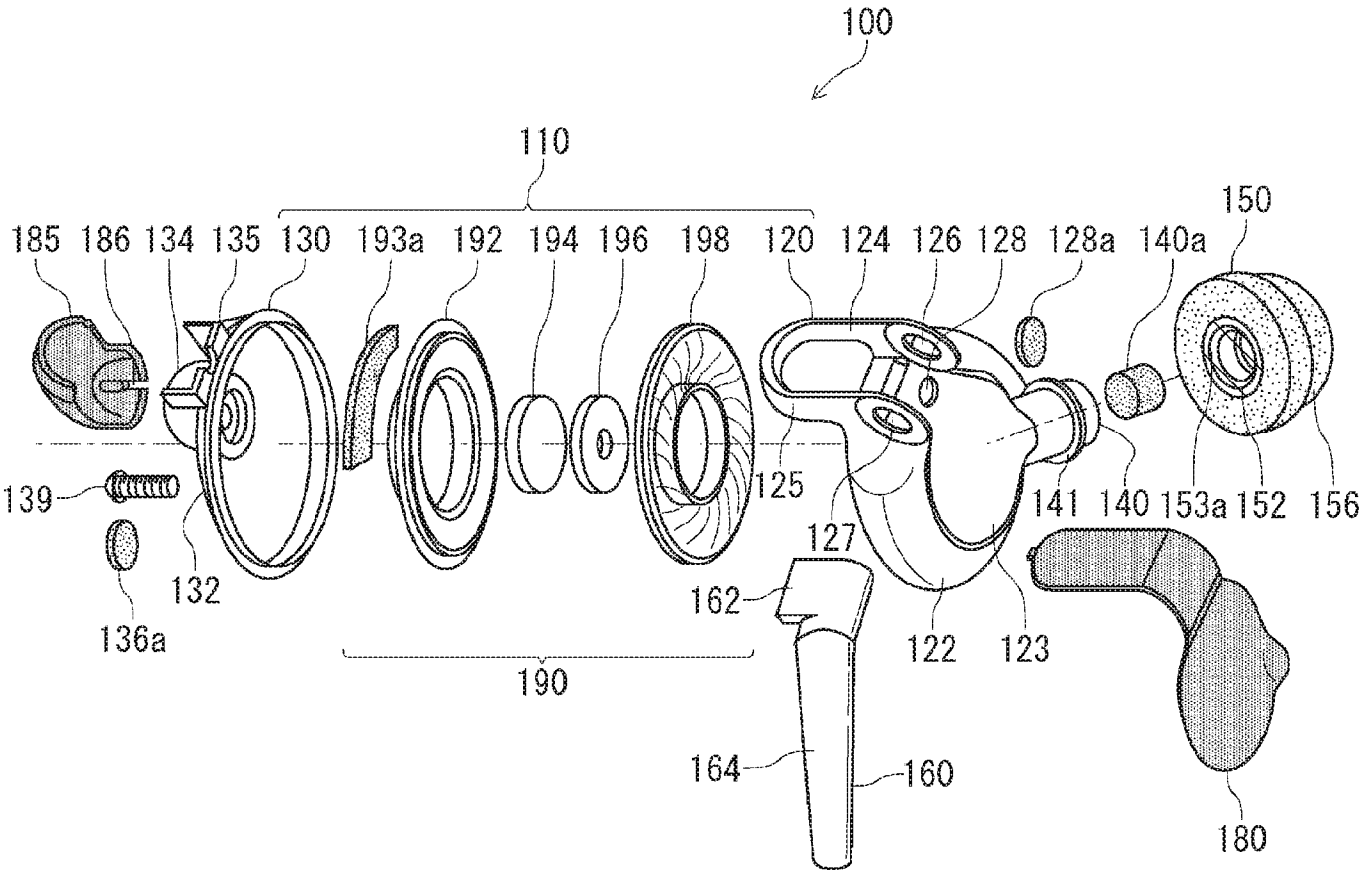
FIG. 7 is an exploded perspective view of the headphone 100 illustrated in FIGS. 1 to 6.

Next, the internal configuration of the headphone 100 to which the earpiece 150 to which the technology disclosed herein is applied to is attached to will be described. FIG. 7 illustrates the exploded headphone 100. Further, FIG. 8 illustrates a cross section of the headphone 100 (cross section vertical to an attachment face P of a diaphragm 198 and including a central axis C1 of the sound conduit 140).

Figure 8:
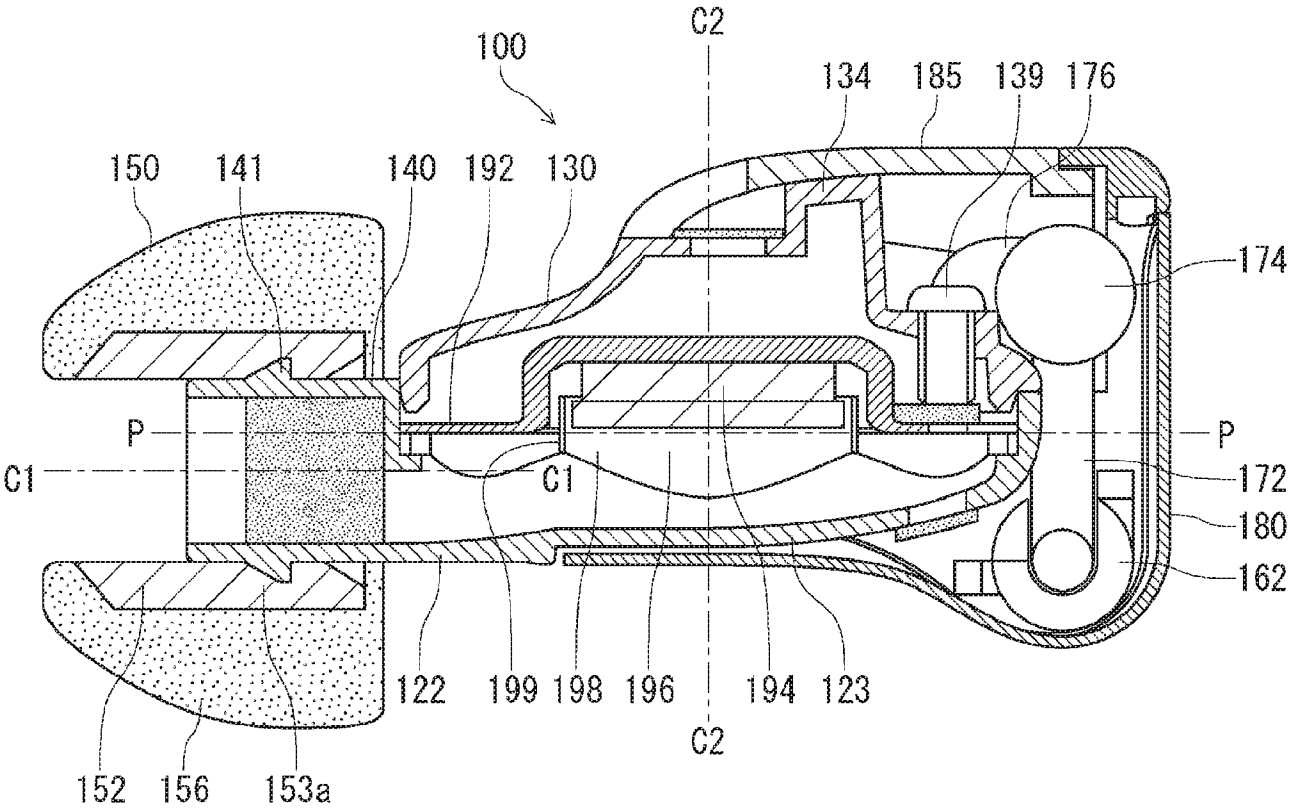
FIG. 8 is a cross-sectional view of the headphone 100 illustrated in FIGS. 1 to 6.

As illustrated in FIGS. 7 and 8, the housing 110 includes a front housing 120 and a back housing 130. The front housing 120 and the back housing 130 are each shaped substantially like a bowl, and joined, for example, through ultrasonic welding or the like to form the housing 110. The housing 110 houses a driver unit 190.

The front housing 120 includes a front section 122 that is shaped substantially like a bowl, the sound conduit 140 that protrudes from a part of the side wall included in the front section 122, and a bent section 124 that is included in another part of the side wall. When the headphone 100 is worn in the left ear of a wearer, the front section 122 is disposed substantially on the frontal side of the wearer, the sound conduit 140 is disposed to have substantially the same axis as the axis of the ear canal of the wearer, and the bent section 124 is disposed substantially on the side of the wearer.

A concave section 123 is formed at the portion corresponding to the bottom of the bowl of the front section 122. An air vent 128 is formed near the border between the concave section 123 and the bent section 124. The bent section 124 is a substantially U-shaped plane as viewed from the side of the wearer, and includes a side wall 125 that protrudes from the side wall included in the front section 122. The bent section 124 has a space therein to house the bushing 160 and the cord 170. The space is surrounded by the side wall 125. The air vent 126 and a bushing attachment hole 127 are provided to the portion of the side wall 125 positioned on the border side of the front section 122. Further, an annular engagement convex section 141 is formed near the tip of the sound conduit 140 for engaging with the inner wall of the earpiece 150.

The back housing 130 includes a back section 132 that is shaped substantially like a bowl, and a curved section 134 that has the shape of a plane curved toward a part of the portion corresponding to the bottom of the bowl. A side wall 135 stands on the curved section 134. The curved section 134 has a space therein to house the cord 170. The space is surrounded by the side wall 135. When the headphone 100 is worn in the left ear of a wearer, the back section 132 is disposed substantially on the back side of the wearer, and the curved section 134 is disposed in the upper space of the antitragus without interfering with the pinna of the wearer. Further, the back section 132 positioned under the curved section 134 is disposed in an intertragic notch d (see FIG. 1) along with the front section 122 positioned under the bent section 124.

The back section 132 has the shape substantially corresponding to the shape of the front section 122. The space formed by the side wall 135 of the curved section 134 has substantially the same width as the width of the space formed by the side wall 125 of the bent section 124. Both spaces are connected to form a single space.

The earpiece 150 includes a shaft 152 that is attached to the sound conduit 140, and an ear canal attachment section 156 that is attached to the outer side of the shaft 152 and comes into contact with an ear canal inner wall (i.e., the skin of a human) of a wearer. An annular engagement concave section 153 is provided to the inner wall of the shaft 152 to engage with the engagement convex section 141 (described above) of the sound conduit 140. The earpiece 150 includes the ear canal attachment section 156 over the whole exterior of which soft silicone foam, which is a foamed material, is disposed. Further, the tip portion of the sound conduit 140 in the earpiece 150 is shaped to be easily wound without blocking the sound path, thereby making it possible to maintain comfortable wearability while keeping the earpiece 150 in close contact with the ear canal. An annular engagement convex section 154 is provided to the outer wall of the shaft 152 for engaging with the inner wall of the ear canal attachment section 156. Further, the ear canal attachment section 156 is hollow and allows the shaft 152 to be plugged through the ear canal attachment section 156. An annular engagement concave section 157 is provided to the inner wall thereof for engaging with the engagement convex section 154 of the shaft 152. The earpiece 150 is worn in an ear canal of a wearer to have substantially the same axis as the axis of the ear canal. The earpiece 150 will be described below in detail.

The bushing 160 includes an attachment section 162 and a cord fixation section 164 that extends from the attachment section 162. The attachment section 162 is attached to the bushing attachment hole 127 provided to the bent section 124 of the front housing 120, and can slightly pivot. The cord fixation section 164 fixes, to the housing 110, the position at which the cord 170 connected to the driver unit 190 is pulled out.

The front cap 180 is formed to cover the space formed by the concave section 123 of the front housing 120 and the side wall 125 of the bent section 124. The back cap 185 is connected to the bent section 124 of the front housing 120 to cover the space formed by the side wall 135 of the curved section 134 of the back housing 130. There is an air vent 186 obtained by drilling an end of the back cap 185. Further, the front cap 180 and the back cap 185 are formed to respectively cover the air vent 128 and an air vent 136 on the front housing 120 and the back housing 130.

As illustrated in FIG. 3, the cord 170 is disposed on the back side of the front housing 120 via the attachment section 162 of the bushing 160 disposed in the space formed by the side wall 125 of the bent section 124 of the front housing 120. The cord 170 is pulled into the space formed by the side wall 135 of the curved section 134 of the back housing 130 (cord 172), and is connected to a cord 176 on the driver unit 190 side via a knot 174. The front cap 180 and the back cap 185 are then attached to the front housing 120 and the back housing 130, respectively, thereby protecting the bushing 160 disposed on the back side of the housing 110 and the cord 170.

The driver unit 190 includes a frame 192, a magnet 194, a pole piece 196, and the diaphragm 198. The diaphragm 198 including a voice coil 199 is disposed in the magnetic circuit including the magnet 194 in the driver unit 190. The diaphragm 198 is then driven in accordance with sound signals supplied to the voice coil 199 via the cord 170. The driver unit 190 is grasped between the front housing 120 and the back housing 130 via the frame 192, and integrated with the housing 110, thereby suppressing unnecessary vibration to improve the quality of sounds in the low range. Further, spaces (front cavity and back cavity) are formed at the front and back of the driver unit 190 with the driver unit 190 housed in the housing 110.

Figure 9:
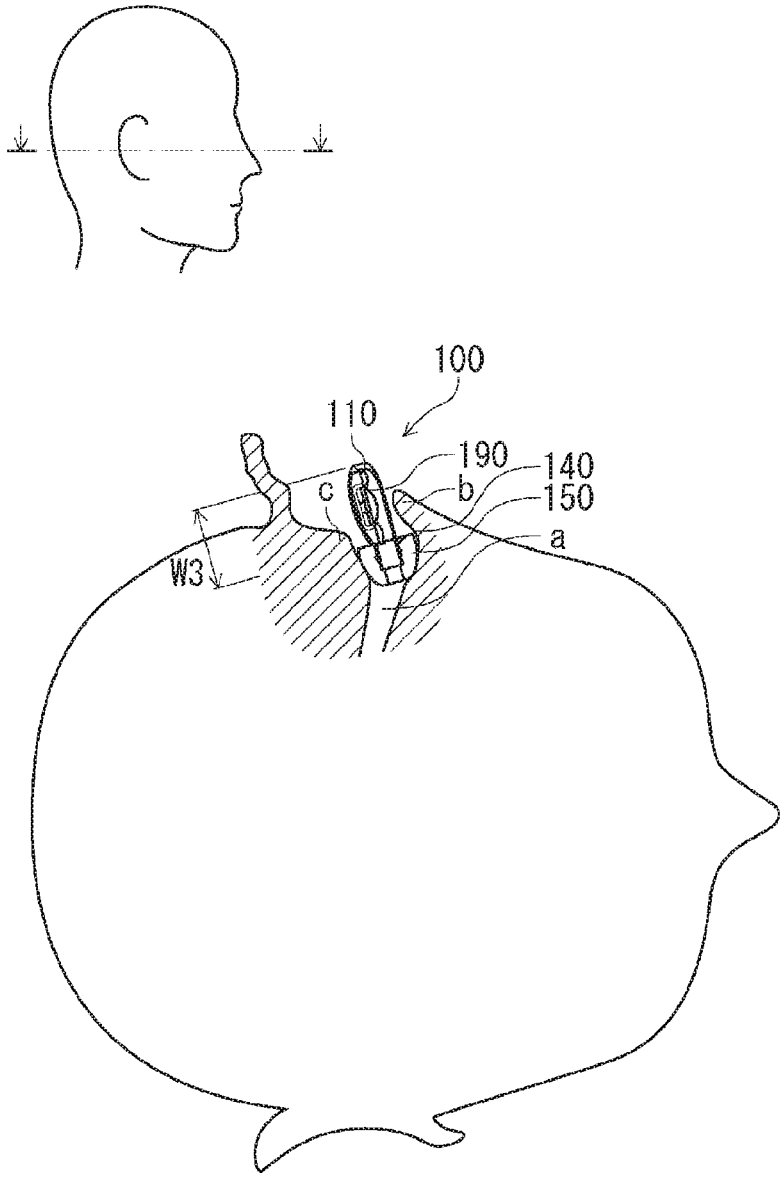
FIG. 9 is a diagram illustrating the headphone 100 worn in a left ear of a wearer.

FIG. 9 is a cross-sectional view of the head of a wearer wearing the headphone 100 in the left ear. As illustrated in FIG. 9, the headphone 100 has the housing 110 disposed in a cavity d of the concha (see FIG. 1). The headphone 100 is attached to an ear canal a via the earpiece 150 attached to the sound conduit 140 with the sound conduit 140 plugged into the ear canal a through the area between a tragus b and an antitragus c. Here, the earpiece 150 can come into closer contact with the ear canal a by deforming to follow the shape of the ear canal a.

The earpiece 150 of the headphone 100 according to the present embodiment includes the shaft 152 that is attached to the sound conduit 140, and the ear canal attachment section 156 that is attached to the outer side of the shaft 152 and comes into contact with an ear canal inner wall (i.e., the skin of a human) of a wearer.

Figure 10:
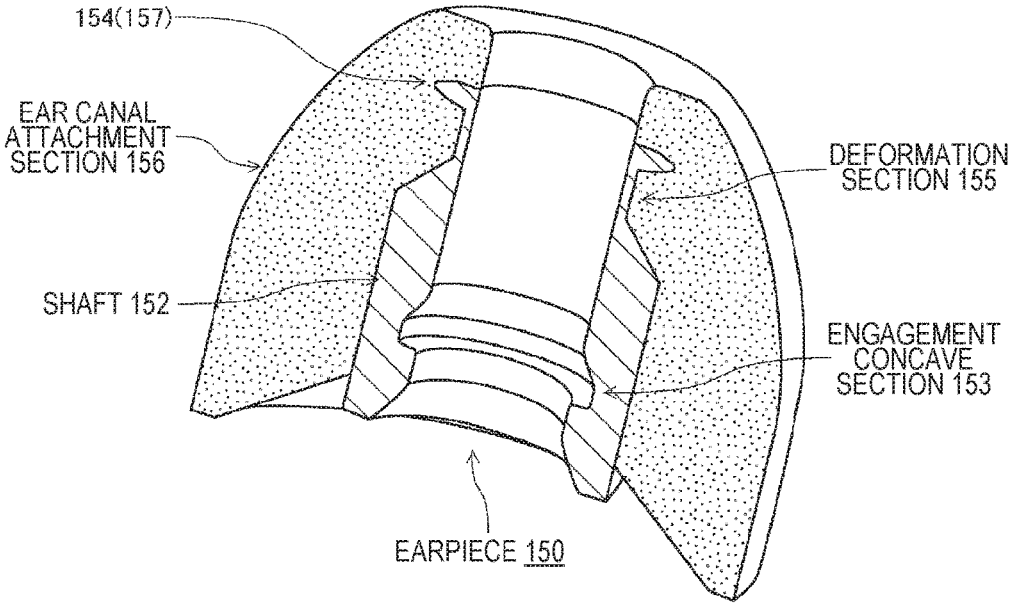
FIG. 10 is a cross-sectional view of an earpiece 150 according to a first embodiment.

FIG. 10 illustrates the cross-sectional configuration of the earpiece 150 according to the first embodiment. The earpiece 150 includes the shaft 152 that is attached to the sound conduit 140, and the ear canal attachment section 156 that is attached to the outer side of the shaft 152 and comes into contact with an ear canal inner wall of the wearer.

Soft silicone foam, which is a foamed material, is disposed over the whole exterior of the ear canal attachment section 156 to maintain the comfortable wearability while keeping close contact with the ear canal. Further, the shaft 152 is formed from silicone rubber or the like. The shaft 152 is harder than the ear canal attachment section 156 made from silicone foam. Even if force is applied, the shaft 152 can retain the original shape to some extent.

Inserting the shaft 152 into the hollow ear canal attachment section 156 (i.e., attaching the ear canal attachment section 156 made from silicone foam to the tip of the sound conduit 140 via the shaft 152) thus makes it possible to have the tip portion of the sound conduit 140 shaped to be easily wound without blocking the sound path (if the tip portion of the sound conduit 140 should be blocked, there would be the problem that the quality of sounds more easily deteriorates), while keeping the earpiece 150 in close contact with the ear canal and allowing the earpiece 150 to be comfortably worn.

Additionally, urethane-based foamed materials such as polyurethane are in the mainstream at the time when the present application is filed. However, for example, earpieces the whole exterior of which is formed from polyurethane are easily hydrolyzed by sweat or the like, and are insufficient from the perspective of durability or comfortability (described above). In contrast, the technology disclosed herein can configure the earpiece 150 that does not deteriorate through hydrolysis, but is excellent in durability and comfortability, by disposing soft silicone foam over the whole exterior of the ear canal attachment section 156. Further, attaching the ear canal attachment section 156 made from silicone foam to the tip of the sound conduit 140 via the shaft 152 makes it possible to have the tip portion of the sound conduit 140 shaped to be easily wound, which prevents the sound path from being blocked, while keeping the earpiece 150 in close contact with the ear canal and allowing the earpiece 150 to be comfortably worn.

Further, there is the problem that difficult processing is necessary to manufacture urethane-based earpieces (described above). In contrast, the ear canal attachment section 156 the whole exterior of which is made from silicone foam can be integrated with the shaft 152 made from silicone rubber, for example, through insert molding, which does not require any adhesion, in the earpiece 150 according to the technology disclosed herein.

A method for integrating the ear canal attachment section 156 made from silicone foam with the shaft 152 made from silicone rubber through insert molding requires easier processing or costs less than a method for manufacturing and then assembling the ear canal attachment section 156 made from silicone foam and the shaft 152 made from silicone rubber as different parts, and joining the ear canal attachment section 156 made from silicone foam and the shaft 152 made from silicone rubber with an adhesive or the like. Accordingly, mass production is possible. Further, insert molding scarcely makes a gap between the ear canal attachment section 156 and the shaft 152. Further, silicone foam has excellent compatibility with silicone rubber. The ear canal attachment section 156 does not part from the shaft 152 after used. Accordingly, it is possible to eliminate a cause of sound leaking.

The structure of the earpiece 150 will be described in more detail. The annular engagement concave section 153 is provided to the inner wall of the shaft 152 formed from silicone rubber to engage with the engagement convex section 141 (not illustrated in FIG. 10) of the sound conduit 140. Further, the annular engagement convex section 154 is provided to the outer wall of the shaft 152 for engaging with the inner wall of the ear canal attachment section 156.

Meanwhile, the ear canal attachment section 156 is hollow and allows the shaft 152 to be inserted thereinto. The annular engagement concave section 157 is provided to the inner wall thereof. As illustrated in the figure, the engagement concave section 157 engages with the engagement convex section 154 on the shaft 152 side. As described above, soft silicone foam, which is a foamed material, is disposed over the entire exterior of the ear canal attachment section 156. The outer surface of the ear canal attachment section 156 comes into contact with the skin (inner wall of the ear canal) of a wearer, but there is no possibility of hydrolysis. The ear canal attachment section 156 is excellent in durability and comfortability.

Figure 11:
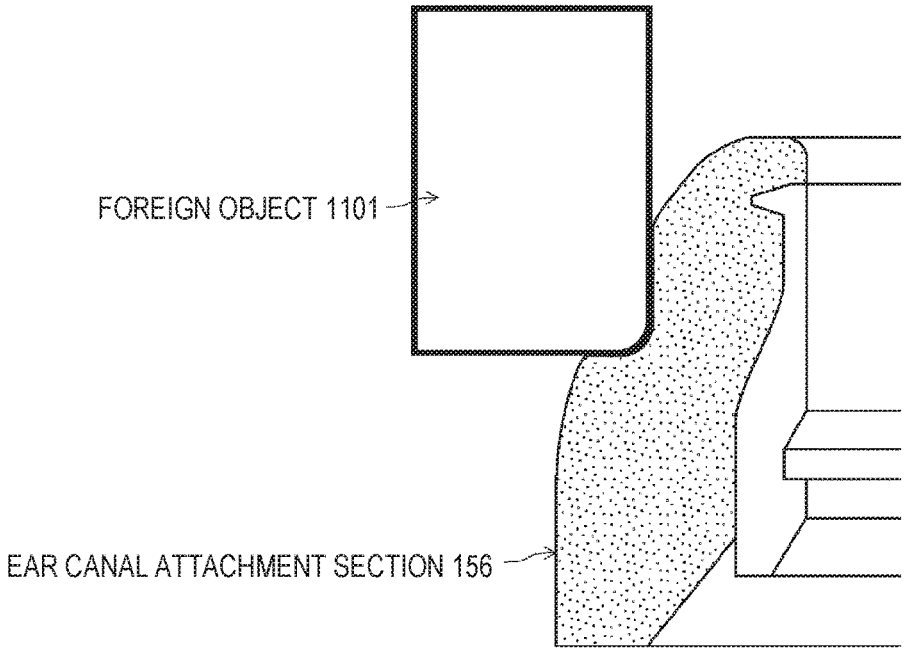
FIG. 11 is a diagram illustrating that an ear canal attachment section 156 deforms when a foreign object 1101 is pushed against the earpiece 150 according to the first embodiment.

FIG. 11 illustrates that the ear canal attachment section 156 deforms when a foreign object 1101 having a quadrangular cross section is pushed against the earpiece 150 (outer surface of the ear canal attachment section 156) according to the present embodiment. The foreign object 1101 is considered as the inner wall of an ear canal, which abuts the headphone 100 when the headphone 100 is worn in the ear of the wearer (i.e., when the earpiece 150 is plugged into the ear canal). If silicone foam disposed over the entire exterior of the ear canal attachment section 156 is softened to the appropriate extent, the ear canal attachment section 156 deforms along the contour of the foreign object 1101 as illustrated in FIG. 11. Accordingly, it is possible to keep very close contact with the foreign object 1101, achieving excellent sound insulation (quality of sounds) and comfortability.

Figure 12:
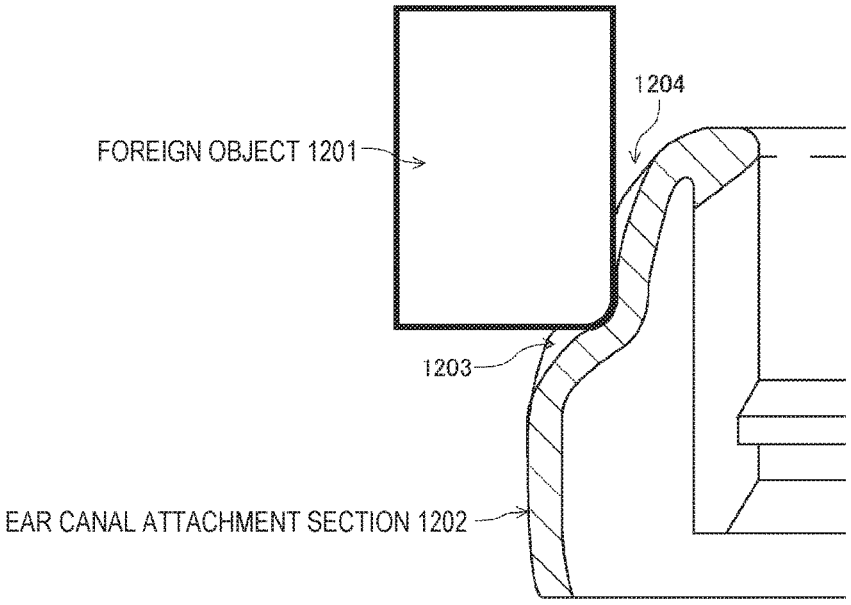
FIG. 12 is a diagram illustrating that a shade-shaped ear canal attachment section 1202 formed from an elastic material deforms when a foreign object 1201 is pushed against the ear canal attachment section 1202.

Further, FIG. 12 illustrates as a comparison that a shade-shaped ear canal attachment section (see, for example, Patent Literature 1) 1202 formed from an elastic material such as silicone rubber deforms when a foreign object 1201 having a quadrangular cross section is pushed against the ear canal attachment section 1202. The shade-shaped ear canal attachment section 1202 has gaps denoted with the reference numbers 1203 and 1204 when the tip of the foreign object 1201 is pushed against the shade-shaped ear canal attachment section 1202 and the shade deforms. The gaps 1203 and 1204 cause loss of close contact or comfortability, and cause the headphone to leak sounds or easily detach from the ear canal. The shade-shaped earpiece 1202 cannot thus achieve the close contact, sound insulation, or comfortability as achieved by the earpiece 150 (see FIG. 11) according to the present embodiment.

FIG. 10 will be referred to again. The shaft 152 includes a deformation section 155 that is thinner and more easily deforms toward the tip. The deformation section 155 is easy to wind, for example, when the earpiece 150 is plugged into an ear canal of a wearer. Further, the engagement convex section 154 is provided to the tip of the shaft 152, for example, along the opening. The engagement convex section 154 also serves as a thick section that is thick, and makes the opening at the tip of the shaft 152 more difficult to crush and prevents the sound path from being blocked even when the shaft 152 is greatly bent near the deformation section 155.

Figure 13:
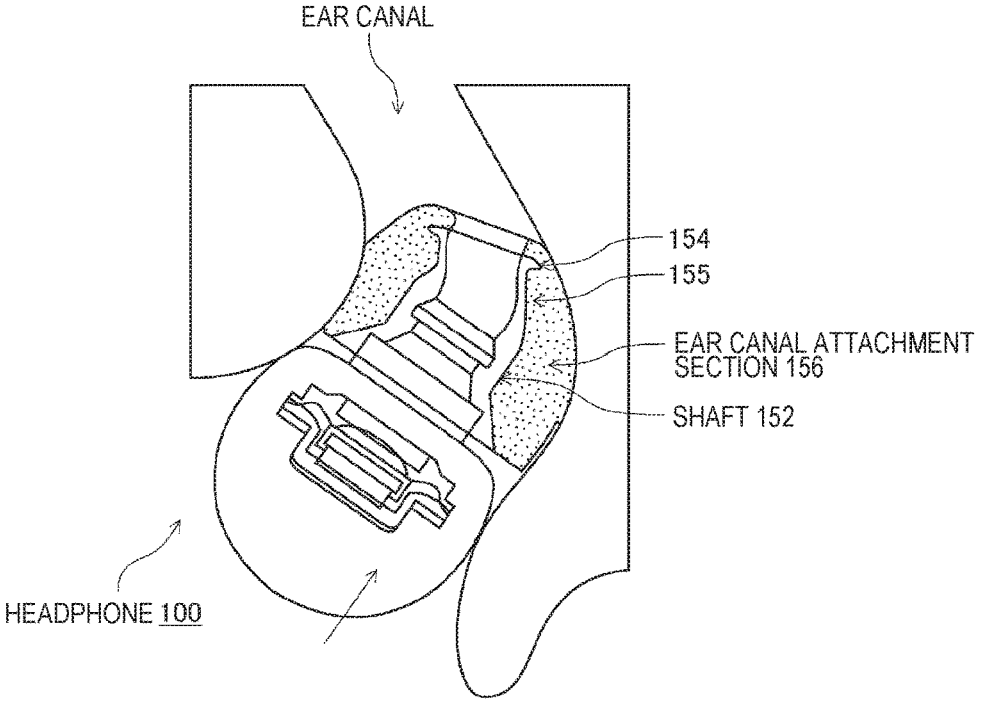
FIG. 13 is a diagram illustrating that the earpiece 150 deforms when the headphone 100 according to the first embodiment is plugged into an ear canal entrance.

FIG. 13 illustrates that the earpiece 150 deforms when the headphone 100 according to the present embodiment is plugged into an ear canal entrance. As already described with reference to FIG. 11, the ear canal attachment section 156 made from silicone foam, which is appropriately soft, can keep close contact and achieve excellent sound insulation (quality of sounds) by deforming along the shape of an ear canal of a wearer. Further, the shaft 152 inserted into the hollow ear canal attachment section 156 is greatly bent and escapes chiefly near the deformation section 155 along with the deformation of the ear canal attachment section 156, thereby making it easier for the earpiece 150 to move further inside the ear canal to improve the wearability and sound insulation. Further, even if the shaft 152 is wound at the deformation section 155, the shaft 152 increases in thickness at the engagement convex section 154. Accordingly, the opening at the tip of the shaft 152 is difficult to crush, and the sound path is not blocked. It is understood from FIG. 13 that the earpiece 150 according to the present embodiment has the tip portion of the sound conduit 140 shaped to be easily wound, which prevents the sound path from being blocked, while maintaining close contact with the ear canal and comfortable wearability. Additionally, the ear canal attachment section 156 unevenly deforms on the left part of FIG. 13 that abuts the inside corner of the first curve and on the right part of FIG. 13 that abuts the outside corner of the first curve in the example illustrated in FIG. 13 in which the earpiece 150 is worn in an ear canal.

Figure 14:
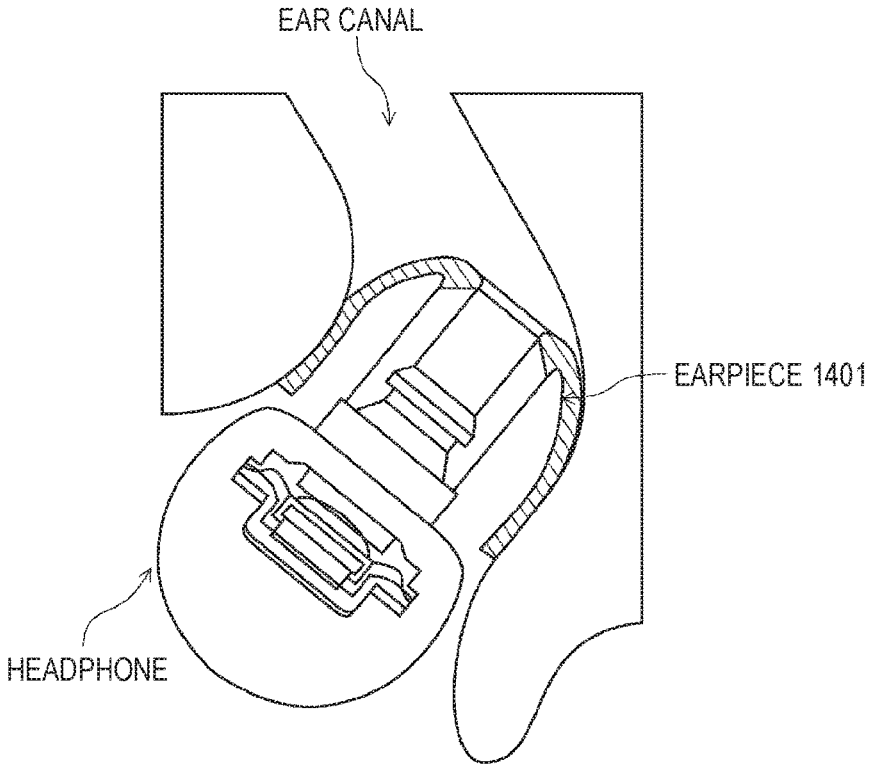
FIG. 14 is a diagram illustrating that a shade-shaped earpiece formed from an elastic material deforms when a headphone including the earpiece is plugged into an ear canal entrance.

Further, FIG. 14 illustrates as a comparison that a shade-shaped earpiece (see, for example, Patent Literature 1) 1401 formed from an elastic material such as silicone rubber deforms when a headphone including the earpiece 1401 is plugged into an ear canal entrance. The shade-shaped earpiece 1401 abuts the inner wall of the ear canal and deforms. However, the silicone rubber, which is a material thereof, is not as flexible as silicone foam, which is a foamed material. As already described with reference to FIG. 12, it is not therefore possible to achieve the close contact, sound insulation, or comfortability as achieved in the present embodiment because gaps are made when the shade is warped.

Figure 15:
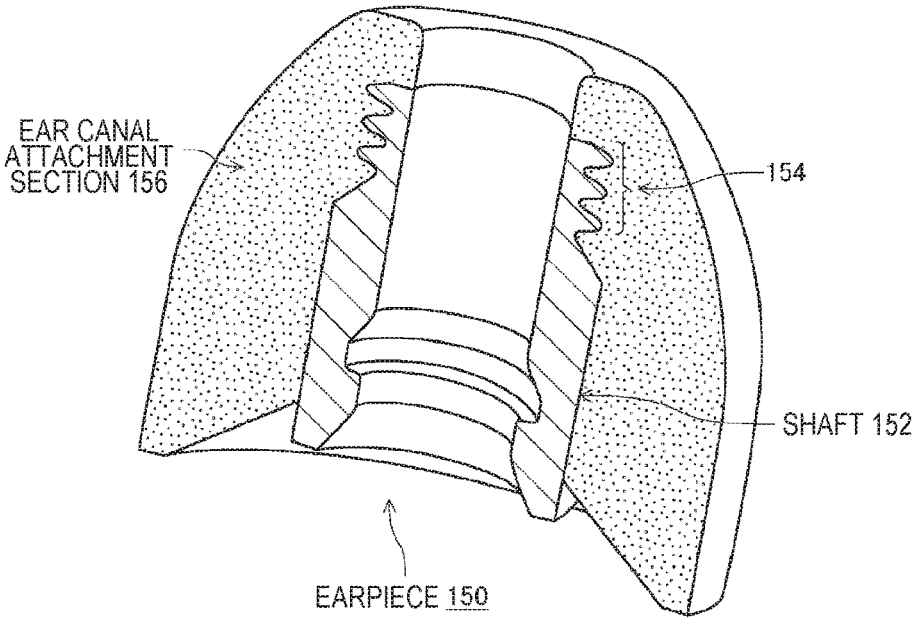
FIG. 15 is a cross-sectional view of the earpiece 150 according to a second embodiment.

FIG. 15 illustrates the cross-sectional configuration of the earpiece 150 according to the second embodiment. The earpiece 150 includes the shaft 152 that is attached to the sound conduit 140, and the ear canal attachment section 156 that is attached to the outer side of the shaft 152 and comes into contact with an ear canal inner wall of the wearer.

The second embodiment is different from the first embodiment in that the annular engagement convex sections 154 are provided to the outer wall of the shaft 152 for engaging with the inner wall of the ear canal attachment section 156, and the annular engagement convex sections 154 are pleated. Further, the corresponding parts of the inner wall of the ear canal attachment section 156 are provided with annular engagement concave sections. Similarly to the earpiece 150 according to the first embodiment, the ear canal attachment section 156 made from silicone foam, which is appropriately soft, can keep close contact and achieve excellent sound insulation (quality of sounds) by deforming along the shape of an ear canal of a wearer. Further, the portion near the tip of the shaft 152 increases in thickness at the engagement convex sections 154. Accordingly, the shaft 152 has the tip portion of sound conduit 140 shaped to be easily wound, which prevents the sound path from being blocked.

Figure 16:
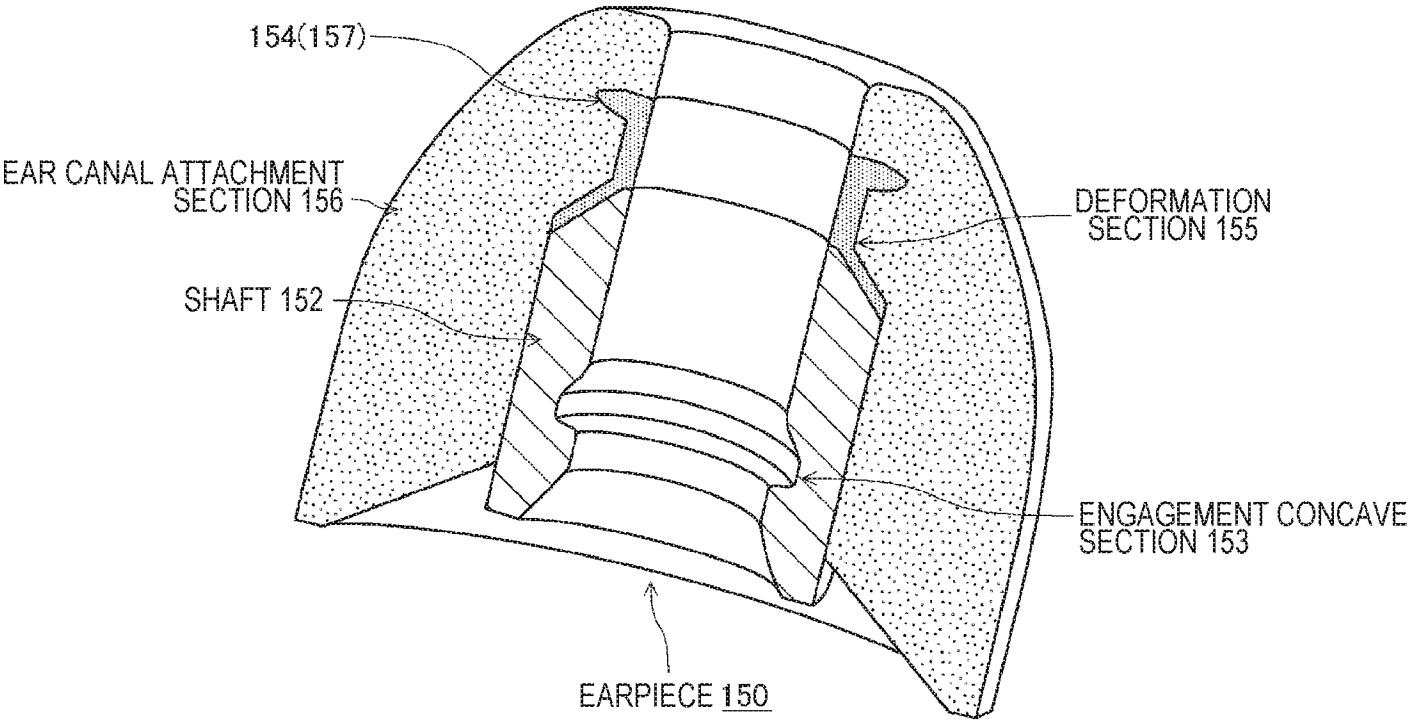
FIG. 16 is a cross-sectional view of the earpiece 150 according to a third embodiment.

Further, FIG. 16 illustrates the cross-sectional configuration of the earpiece 150 according to the third embodiment. The earpiece 150 includes the shaft 152 that is attached to the sound conduit 140, and the ear canal attachment section 156 that is attached to the outer side of the shaft 152 and comes into contact with an ear canal inner wall of a wearer.

The shaft 152 includes a deformation section 155 that is thinner and more easily deforms toward the tip. The deformation section 155 is easy to wind, for example, when the earpiece 150 is plugged into an ear canal of a wearer. The third embodiment is different from the first embodiment in that the shaft 152 includes two silicone rubber materials (or three or more types of material) having different mechanical characteristics such as elasticity for the portion from the deformation section 155 to the base, and the deformation section 155 and the portion from the deformation section 155 to the tip. FIG. 16 illustrates the difference of the shaft 152 in materials with the light and dark shading. The portion (shaded in light color) near the tip of the shaft 152 corresponds to the deformation section 155. It is possible to adjust the elasticity for the deformation section 155 to more easily deform than the base side (shaded in dark color) of the shaft 152, and have the tip portion of the sound conduit 140 shaped to be more easily wound, which prevents the sound path from being blocked. It is possible to easily manufacture the shaft 152 made from two different silicone rubber materials as illustrated in FIG. 16 using the molding technology such as insert molding or two-color molding.

Further, similarly to the first embodiment, the ear canal attachment section 156 made from silicone foam, which is appropriately soft, in the earpiece 150 according to the third embodiment can keep close contact and achieve excellent sound insulation (quality of sounds) by deforming along the shape of an ear canal of a wearer.

Figure 17:
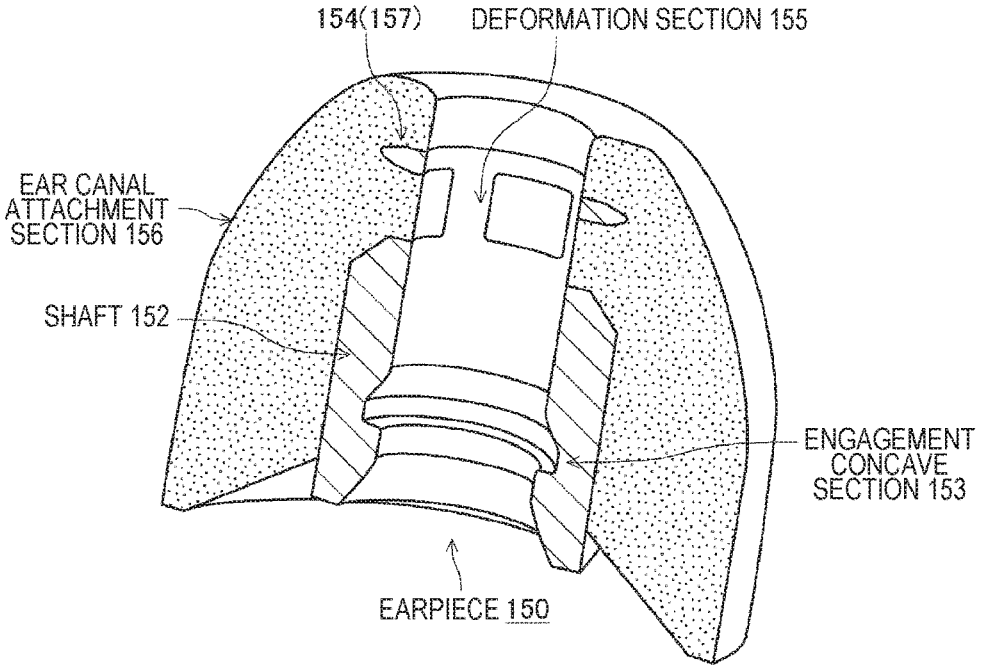
FIG. 17 is a cross-sectional view of the earpiece 150 according to a fourth embodiment.

Further, FIG. 17 illustrates the cross-sectional configuration of the earpiece 150 according to the fourth embodiment. The earpiece 150 includes the shaft 152 that is attached to the sound conduit 140, and the ear canal attachment section 156 that is attached to the outer side of the shaft 152 and comes into contact with an ear canal inner wall of the wearer.

The fourth embodiment is different from the first to third embodiments in that the deformation section 155 formed at the tip of the shaft 152 is not cylindrical as in the first to third embodiments, but is configured to support the thick section (engagement convex section) 154 at the tip using columnar projections formed in the axial direction of the shaft 152. Similarly to the earpiece 150 according to the first embodiment, the ear canal attachment section 156 made from silicone foam, which is appropriately soft, can keep close contact and achieve excellent sound insulation (quality of sounds) by deforming along the shape of an ear canal of a wearer. Further, the portion near the tip of the shaft 152 increases in thickness at the engagement convex sections 154.Accordingly, the shaft 152 has the tip portion of sound conduit 140 shaped to be easily wound, which prevents the sound path from being blocked.

Figure 18:
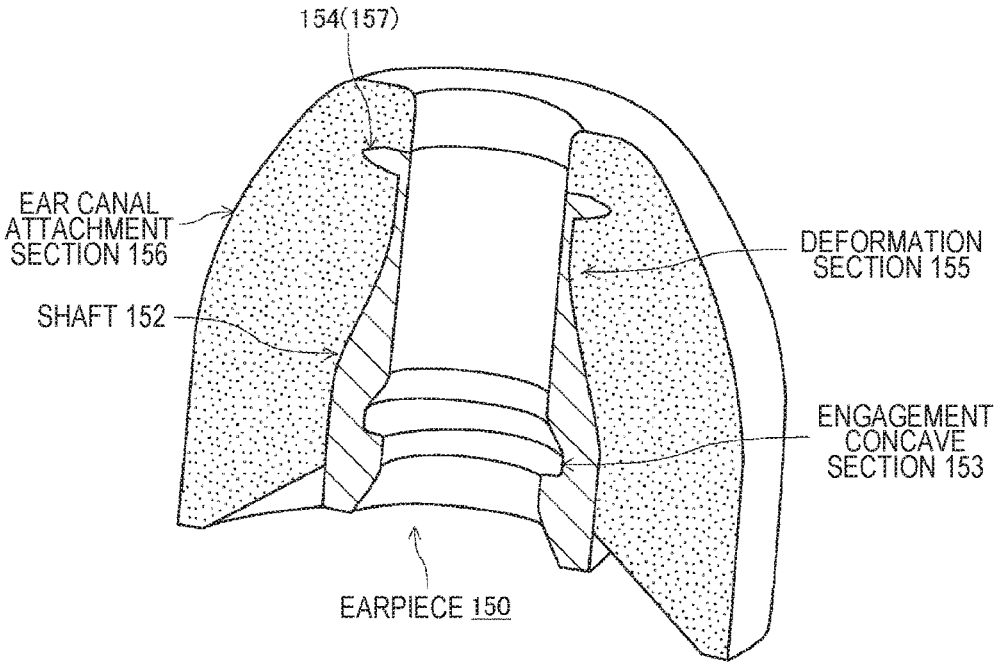
FIG. 18 is a cross-sectional view of the earpiece 150 according to a fifth embodiment.

Further, FIG. 18 illustrates the cross-sectional configuration of the earpiece 150 according to a fifth embodiment. The earpiece 150 includes the shaft 152 that is attached to the sound conduit 140, and the ear canal attachment section 156 that is attached to the outer side of the shaft 152 and comes into contact with an ear canal inner wall of a wearer.

The deformation section 155 formed at the tip of the shaft 152 is more gently sloped than that of the first embodiment (see FIG. 10). Similarly to the earpiece 150 according to the first embodiment, the ear canal attachment section 156 made from silicone foam, which is appropriately soft, can keep close contact and achieve excellent sound insulation (quality of sounds) by deforming along the shape of an ear canal of a wearer. Further, the portion near the tip of the shaft 152 increases in thickness at the engagement convex sections 154.Accordingly, the shaft 152 has the tip portion of sound conduit 140 shaped to be easily wound, which prevents the sound path from being blocked. It should be noted that the shaft 152 or the deformation section 155 near the tip thereof is not limited to a specific shape in order that the earpiece 150 attains a desired effect.

Figure 19:
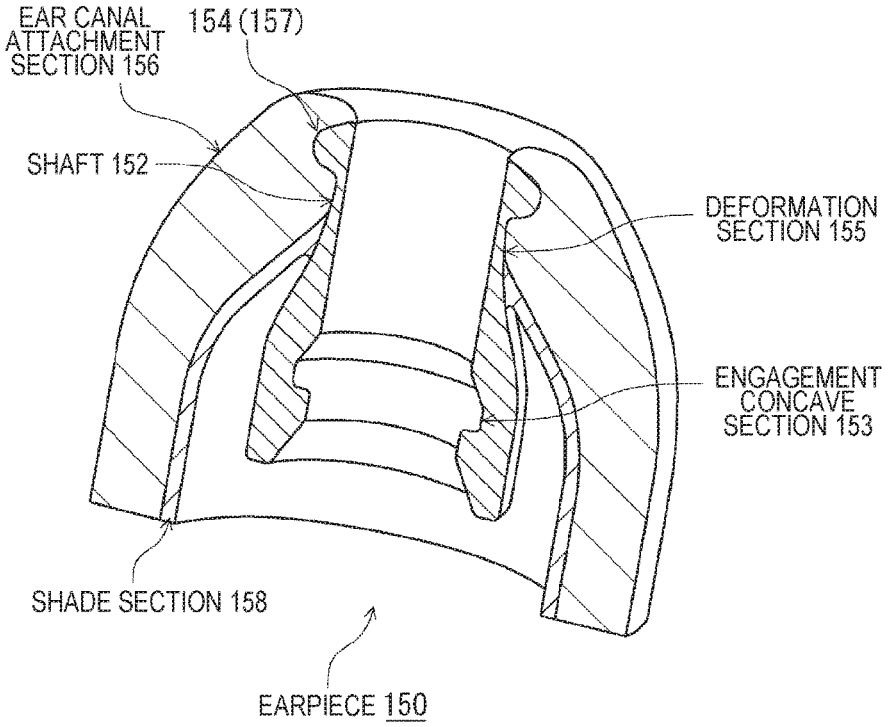
FIG. 19 is a cross-sectional view of the earpiece 150 according to a sixth embodiment.

FIG. 19 illustrates the cross-sectional configuration of the earpiece 150 according to a sixth embodiment. The earpiece 150 includes the shaft 152 that is attached to the sound conduit 140, and the ear canal attachment section 156 that is attached to the outer side of the shaft 152 and comes into contact with an ear canal inner wall of a wearer. Further, different from the earpiece 150 according to the first to fifth embodiments, the earpiece 150 illustrated in FIG. 19 has the ear canal attachment section 156 attached to the outer side of the shaft 152 via a shade section 158 including a thin film, and a space is formed between this shade section 158 and the shaft 152. Soft silicone foam, which is a foamed material, is disposed over the entire exterior of the ear canal attachment section 156.

Additionally, the ear canal attachment section 156 unevenly deforms on the left part of FIG. 13 that abuts the inside corner of the first curve and on the right part of FIG. 13 that abuts the outside corner of the first curve in the example illustrated in FIG. 13 in which the earpiece 150 is worn in an ear canal (described above). The left and right of the ear canal attachment section 156 deform to different degrees when worn in an ear canal, which can be similarly applied to the second to fifth embodiments respectively illustrated in FIGS. 15 to 18. Greater deformation means that the resilience generated in silicone foam is greater in the left side of FIG. 13. Such partial pressure affects the stability of the main body of the headphone 100, consequently arousing concern that the wearability of the earpiece 150 in an ear canal deteriorates.

The earpiece 150 is then configured in the sixth embodiment illustrated in FIG. 19 in a manner that the ear canal attachment section 156 is attached via the shade section 158 that includes a thin film and forms a space between the shade section 158 and the shaft 152 as described above. Even if the shape of the ear canal attachment section 156 in the radial direction greatly deforms in part as illustrated in FIG. 13, it is thus possible to follow the deformation using the space formed by the shade section 158 to prevent the wearability from deteriorating.

The following summarizes the advantages of an earpiece including an ear canal attachment section over the entire exterior of which soft silicone foam, which is a foamed material, is disposed.

(1) There is no possibility that a silicone foam material is hydrolyzed by moisture such as sweat or earwax, so that excellent durability is secured.
(2) It is possible to wash an earpiece using water or a detergent and keep the earpiece clean.
(3) Soft silicone foam causes less pressure on an ear of a wearer when a headphone is worn, so that the wearer feels comfortable.
(4) Soft silicone foam does not breathe, so that it is easy to close an ear canal when a headphone is worn, which achieves excellent noise isolation.
(5) A deformation section is formed near the tip of a shaft that supports an ear canal attachment section of silicone foam, so that the tip of the shaft is wound and escapes to move further inside an ear canal when an earpiece is plugged into the ear canal, which improves the wearability and noise isolation.
(6) Even if a portion near the tip of a shaft is wound, the tip increases in thickness and has a shape difficult to crush, which scarcely blocks a sound path or loses the quality of sounds.

INDUSTRIAL APPLICABILITY

The foregoing thus describes the technology disclosed in this specification in detail and with reference to specific embodiments. However, it is obvious that persons skilled in the art may make modifications and substitutions to these embodiments without departing from the spirit of the technology disclosed in this specification.

The technology disclosed herein is not limited to earpieces, but can be applied to various types of wearable device that is used directly in contact with the skin of a living body. For example, if the technology disclosed herein is applied to the ear pads of headphones, headbands (or headband-type information terminals), the temples of glasses (or glasses-type information terminals), the packing of swimming goggles, the inner sides of the wristbands of watches (or watch-type information terminals), the insoles of shoes (or shoe-type information terminal) or the like, the inner sides of helmets, pillows, cushions, or the like, it is possible to follow the three-dimensional shapes directly in contact with the skins or body parts of living bodies such as humans.

Further, the technology disclosed herein can also be applied to various current products that use another foamed material such as urethane.

Essentially, the technology disclosed in this specification has been described by way of example, and the stated content of this specification should not be interpreted as being limiting. The spirit of the technology disclosed in this specification should be determined in consideration of the claims.

Additionally, the present technology may also be configured as below.

(1)

A wearable device including:

a contact section that has silicone foam disposed over a whole exterior thereof, and comes into contact with a skin of a living body; and a support section of the contact section.

(2)

The wearable device according to (1), in which the wearable device is configured as an earpiece for a headphone that is plugged into an ear canal of a human or another living body, the support section is a hollow shaft that is attached to a sound conduit of the headphone, and the contact section is an ear canal attachment section that is attached to an outer side of the shaft and comes into contact with an ear canal inner wall.

(3)

The wearable device according to (2), in which the shaft is made from a more rigid material than a material of the ear canal attachment section.

(4)

The wearable device according to (2), in which the shaft is made from silicone rubber.

(5)

The wearable device according to (4), in which the earpiece is manufactured by applying insert molding to the shaft and the ear canal attachment section.

(6)

The wearable device according to any of (2) to (5), in which the shaft includes a deformation section that easily deforms in accordance with an external force applied via the ear canal attachment section.

(7)

The wearable device according to (6), in which the deformation section is formed by making the shaft thinner toward a shaft tip.

(8)

The wearable device according to (6), in which the deformation section is formed from a more elastic material than a material of another portion of the shaft.

(9)

The wearable device according to any of (1) to (8), in which the shaft further includes a thick section that makes an opening at a tip of the shaft difficult to crush.

(10)

The wearable device according to (9), in which the thick section is provided to the tip of the shaft.

(11)

The wearable device according to any of (2) to (10), further including:

a shade section that includes a thin film and forms a space between the shade section and the shaft, in which the ear canal attachment section is attached to the shaft via the shade section.

REFERENCE SIGNS LIST

100 headphone
110 housing
120 front housing
122 front section
123 concave section
124 bent section
125 side wall
126 air vent
127 bushing attachment hole
128 air vent
130 back housing
132 back section
134 curved section
135 side wall
136 air vent
140 sound conduit
141 engagement convex section
150 earpiece
152 shaft
153 engagement concave section
154 engagement convex section
155 deformation section
156 ear canal attachment section
157 engagement concave section
158 shade section
160 bushing
162 attachment section
164 cord fixation section
170, 172, 176 cord
174 knot
180 front cap
185 back cap
186 air vent
190 driver unit
192 frame
194 magnet
196 pole piece
198 diaphragm
199 voice coil

The invention claimed is:

1. A wearable device, comprising: an ear canal attachment section that has silicone foam over a whole exterior of the ear canal attachment section, wherein the ear canal attachment section is configured to come into contact with a skin of a living body; and a support section attachable to the ear canal attachment section, wherein the support section is a hollow shaft, the hollow shaft includes a deformation section at a first portion of the hollow shaft, the first portion is at a tip of the hollow shaft, and the deformation section at the tip of the hollow shaft is more elastic than at a second portion of the hollow shaft.

2. The wearable device according to claim 1, wherein the wearable device is configured as an earpiece for a headphone that plugs into an ear canal of the living body, the hollow shaft is attached to a sound conduit of the headphone, the ear canal attachment section is attached to an outer side of the hollow shaft, and the ear canal attachment section further comes into contact with an ear canal inner wall of the living body.

3. The wearable device according to claim 2, wherein a material of the hollow shaft is more rigid than a material the ear canal attachment section.

4. The wearable device according to claim 3, wherein the material of the hollow shaft is silicone rubber.

5. The wearable device according to claim 4, wherein the earpiece comprises the hollow shaft and the ear canal attachment section, and wherein the hollow shaft is attached with the ear canal attachment section by insert molding.

6. The wearable device according to claim 2, wherein the deformation section is configured to deform based on application of an external force through the ear canal attachment section.

7. The wearable device according to claim 6, wherein the first portion is thinner than the second portion of the hollow shaft different from the first portion.

8. The wearable device according to claim 2, wherein the hollow shaft further includes a first section that is thicker than a second section of the hollow shaft, the second section is different from the first section, and wherein the first section provides a mechanical strength to an opening at the tip of the hollow shaft.

9. The wearable device according to claim 8, wherein the first section is at the tip of the hollow shaft.

10. The wearable device according to claim 2, further comprising:

a shade section that includes a film, wherein the shade section provides a space between the shade section and the hollow shaft, wherein the ear canal attachment section is attached to the hollow shaft via the shade section.

11. The wearable device according to claim 2, wherein the hollow shaft further includes an annular engagement convex section at an outer wall of the hollow shaft, and the ear canal attachment section includes an annular engagement concave section at an inner wall of the ear canal attachment section, the annular engagement concave section corresponding to the annular engagement convex section of the hollow shaft.

12. The wearable device according to claim 11, wherein the annular engagement convex section and the annular engagement concave section are configured to engage the ear canal attachment section with the hollow shaft.

* * * * *